US005364293A

United States Patent [19]

Peterson

[11] Patent Number: 5,364,293

[45] Date of Patent: Nov. 15, 1994

[54] SHIELDED STACKABLE SOLDERLESS CONNECTOR/FILTER ASSEMBLY

[75] Inventor: Kevin T. Peterson, Cedar Rapids, Iowa

[73] Assignee: Rockwell International Corp., Seal Beach, Calif.

[21] Appl. No.: 97,338

[22] Filed: Jul. 23, 1993

[51] Int. Cl.[5] ..... H01R 13/66

[52] U.S. Cl. ..... 439/620; 439/74

[58] Field of Search ..... 439/74, 620; 333/184

[56] References Cited

U.S. PATENT DOCUMENTS

| | | | |
|---|---|---|---|
| 4,732,568 | 3/1988 | Hall | 439/676 |
| 4,999,595 | 3/1991 | Azumi et al. | 333/184 |
| 5,023,577 | 6/1991 | Drake | 333/182 |
| 5,083,945 | 1/1992 | Miskin et al. | 439/607 |
| 5,085,590 | 2/1992 | Galloway | 439/95 |
| 5,160,268 | 11/1992 | Hakamian | 439/66 |
| 5,169,320 | 12/1992 | Burkett, Jr. et al. | 439/66 |
| 5,176,526 | 1/1993 | Hillbish et al. | 439/108 |
| 5,207,597 | 5/1993 | Kline et al. | 439/607 |
| 5,219,296 | 6/1993 | Nguyen | 439/620 X |

*Primary Examiner*—Eugene F. Desmond

*Attorney, Agent, or Firm*—Kyle Eppele; M. Lee Murrah; H. Fredrick Hamann

[57] ABSTRACT

An apparatus for use as a connector in certain electronic applications. The disclosed apparatus teaches a connector assembly suitable for use in applications requiring minimal height restrictions while simultaneously affording a solderless, stackable, shielded connector assembly that may include a variety of electronic filtering. A described embodiment of the present invention includes a multi-walled encasement structure of electroplated construction housing a "pi" filter sandwiched between matching layers of resilient conductive layers, each layer having contact pads for coupling to contact pads of adjacent circuit board circuitry.

14 Claims, 2 Drawing Sheets

FIG. 1
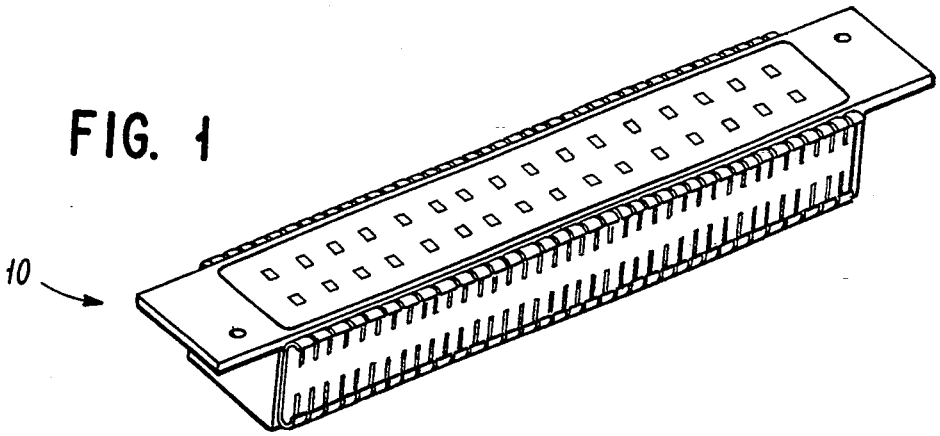
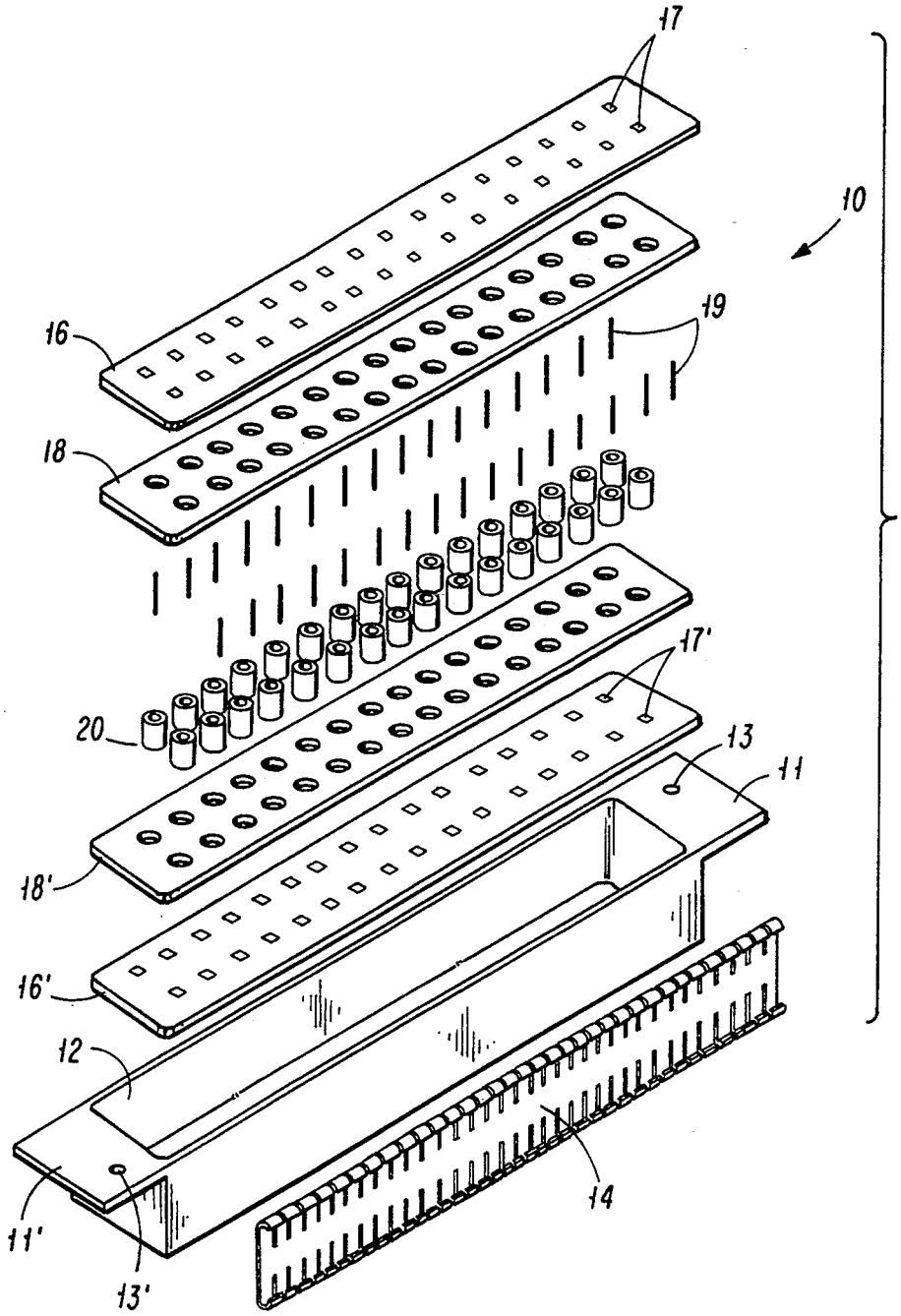
FIG. 2

SHIELDED STACKABLE SOLDERLESS CONNECTOR/FILTER ASSEMBLY

This invention was made with Government support under contract number F33657-91-C-0006 awarded by the United States Air Force. The Government has certain rights in this invention.

FIELD OF THE INVENTION

The present invention relates generally to the art of electrical connector assemblies and more particularly, to such apparatus providing protection against electromagnetic interference (EMI), radio frequency interference (RFI), and the like while also satisfying advanced manufacturing requirements.

BACKGROUND OF THE INVENTION

Electrical connector apparatuses are widely used in such applications as telecommunications equipment, computers and other digital information systems. The modular nature of most electronic equipment necessitates the incorporation of numerous instances of the use of such electrical connectors. Often, it is desirable to shield the signal-carrying circuits to avoid interference caused by energy generated outside of, as well as inside the system, also known as EMI and RFI, respectively.

Typically, interconnection of individual circuit boards is accomplished using chassis-mounted circuit card connectors or wires. Alternatively, circuit card connectors may be mounted onto a first printed circuit board (PCB) allowing additional PCBs to be plugged into the connectors. As determined by the printed circuit on the first board, each additional board may be interconnected to adjacent boards or to distant boards located several connectors away. In either arrangement, the long interconnections between individual circuit boards reduce system electrical performance by introducing timing and phase shift errors and by compromising the isolation of high frequency analog signals from digital signals.

Stackable connectors provide a convenient way to provide two interface ports to a circuit board (top and bottom) without consuming on the circuit board twice the area required for single connectors. Shielding is provided to prevent any currents from being induced in the individual connectors or contacts between two or more connectors. Shielding between the two connectors of a stacked assembly is most critical in high frequency applications.

Prior art solutions to the above problems include the use of electrical circuit board edge connectors designed to minimize interference between circuit board signals and extraneous signals. Other implementations teach connector elements composed of a strand of metal wire wadded together to form a "button" or wadded wire. The buttons may be used in pairs on opposing ends of an electrical conductive element that is positioned within a hole in a block of insulative material.

In addition to signal isolation concerns, systems incorporating interconnecting signal wires or multiple PCB arrangements are difficult to design for very high inertial applications. Specifically, the interconnecting wires and the mother and daughter boards flex under the high inertial forces developed during periods of high shock, acceleration or deceleration and are therefore subject to failure.

Thus, it can readily be seen that many such electrical connector assemblies are used in conjunction with systems which incorporate PCBs having numerous design requirements. Often it is necessary to also house filter means within the connector assembly. Such filter means are typically implemented using through parts such as through capacitors or through inductors coupled with connector pins. Additionally, numerous applications today require stackable connectors thereby providing convenient interface ports for PCBs thereby eliminating approximately one-half of the connector contacts. Finally, modern manufacturing techniques often dictate solderless connections thereby eliminating the expense and material associated with such applications.

Unfortunately, prior art connector assemblies fail to address the numerous design requirements of many applications thereby limiting the design characteristics of the subject equipment. Accordingly, there is a need for a shielded, stackable, solderless connector/filter apparatus.

SUMMARY OF THE INVENTION

The present invention provides an apparatus for use as a connector in certain electronic applications. The disclosed apparatus teaches a connector assembly suitable for use in applications requiring severe height restrictions while simultaneously affording a solderless, stackable, shielded connector assembly that may include a variety of electronic filtering. A described embodiment of the present invention includes a multi-walled encasement structure of electroplated construction housing a "pi" filter sandwiched between matching layers of resilient conductive layers, each layer having contact "buttons" or pads for coupling to contact pads of adjacent printed circuit boards. The "pi" filter is comprised of a plurality of ferrite beads disposed between a pair of planar capacitor arrays. A gold plated copper lead is contained within each ferrite bead and couples an upper and lower contact pad (button) on a compliant elastomeric layer. Alignment means, such as a guidepin hole, provide ease in assembling a plurality of connectors and boards.

It is an object of the present invention to provide an apparatus that allows for improved performance of electrical equipment requiring the use of electrical connector assemblies.

It is yet another object of the present invention to provide an apparatus that allows for ease in assembling a plurality of PCBs requiring connector assemblies.

It is a feature of the present invention to incorporate numerous design parameters into an electrical connector apparatus.

It is an advantage of the present invention to eliminate noise and manufacturing problems associated with prior art electrical connector assemblies.

These and other objects, features and advantages are disclosed and claimed in the specification, figures, and claims of the present application.

BRIEF DESCRIPTION OF THE DRAWINGS

FIG. 1 illustrates an orthogonal view of one embodiment of the present invention.

FIG. 2 illustrates an exploded orthogonal view of the apparatus of FIG. 1.

DETAILED DESCRIPTION OF THE SPECIFIC EMBODIMENTS

Figure 3:
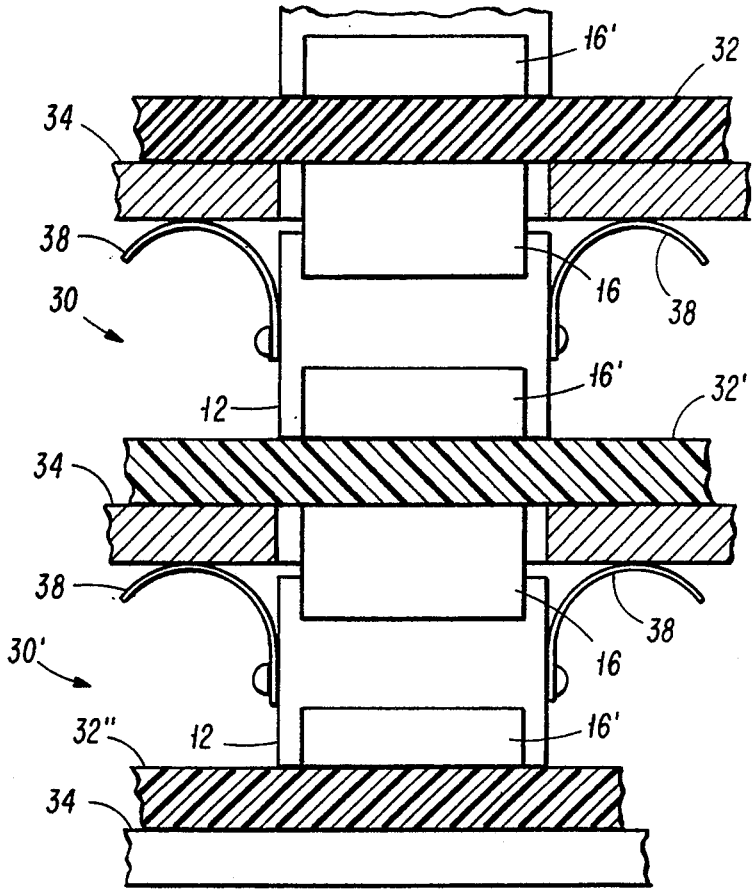
FIG. 3 illustrates a cross-sectional view of an alternate embodiment of two apparatus incorporating the teaching of the present invention disposed between three printed circuit boards.

Turning now to the drawings wherein like items are referenced as such throughout, FIG. 1 shows an assembled embodiment of an electrical connector assembly 10 that incorporates the teachings of the present invention. FIG. 2 depicts the apparatus 10 of FIG. 1 in an exploded orthogonal view. A multi-walled encasement device 12 provides support and shielding for the connector assembly 10. Signal filtering means, as shown comprised of a plurality of ferrite inductor beads 20 disposed between a pair of complimentary planar capacitor arrays 18 and 18', is retained within the multi-walled encasement device 12 and coupled to an overlaying (or underlaying) surface (not shown) via a pair of resilient elastomeric sheets 16, 16'. A plurality of ribbon contacts 17, 17' are strategically located within each non-conductive resilient elastomeric sheet 16, 16' and may also be comprised of similar material as sheets 16. The elastomeric sheets 16, 16' are readily available from Elastomeric Technology, Inc. of Hatboro, Penna. EMI shielding is provided by shielding means 14, such as an EMI gasket conductively attached to multi-walled encasement device 12. Gasket 14 may be welded, soldered, riveted or otherwise conductively attached to the multi-walled encasement device 12. It should be noted that although a rectangular shaped connector assembly having a "pi" filter is shown, the advantages of the present invention are equally applicable to any shaped connector assembly and a variety of filter means including capacitor and resistive filters.

For the above described embodiment a metallic multi-walled encasement device 12, specifically an electro-tin plated steel case is recommended. The multi-walled encasement device 12 has height, length and width dimensions such that the filter means and elastomeric sheets snugly fit or bond within the multi-walled encasement device 12. The height dimension of the multi-walled encasement device 12 is slightly less than the uncompressed height of the elastomeric sheets 26, 26', capacitor arrays 18, 18' and ferrite inductor beads 20. The multi-walled encasement device 12 has protruding flanges 11, 11' at opposite ends along the width dimension. It is understood that the flanges 11, 11' could comprise any combination of similar extensions from any surface of the multi-walled encasement device 12. These can be located anywhere around or upon the multi-walled encasement device 12. Flanges 11, 11' are provided for ease in handling and contain strategically located vias or cavities 13, 13'. During assembly of the connector and the elements being connected matched alignment holes provide easy location and if needed, retention while final assembly is completed. Leads, as shown gold-plated copper leads 19, are located within the plurality of ferrite inductor beads 20 and couples contact pads on the elastomeric layers 16 and 16'.

FIG. 3 illustrates connector assemblies 30, 30' providing electrical connectivity, desired shielding and filtering between three PCBs 32, 32', 32'' to a component 34 having numerous chassis retention surfaces as shown. A pair of grounding clips 38, 38' are shown riveted to a multi-walled encasement device 12. Paired elastomeric sheets 16, 16' provide pass through connectivity from the PCB 32 to PCBs 32', 32'' or any combination thereof. Filtering means are contained within the multi-walled encasement device 12, 12'. The resistive force of compressing connector assembly 30 between PCBs 32, 32' provides satisfactory contact points for compliant pads on the PCBs 32, 32' and matching protrusions on elastomeric sheets 16, 16'. Since the earlier described alignment holes (not shown in FIG. 3) provide proper guidance and if needed, temporary retention of assembly 30, 30' through compliant alignment holes in the PCBs 32, 32', 32'' and component chassis 34, respectively, the need for soldering is eliminated.

Figure 4:
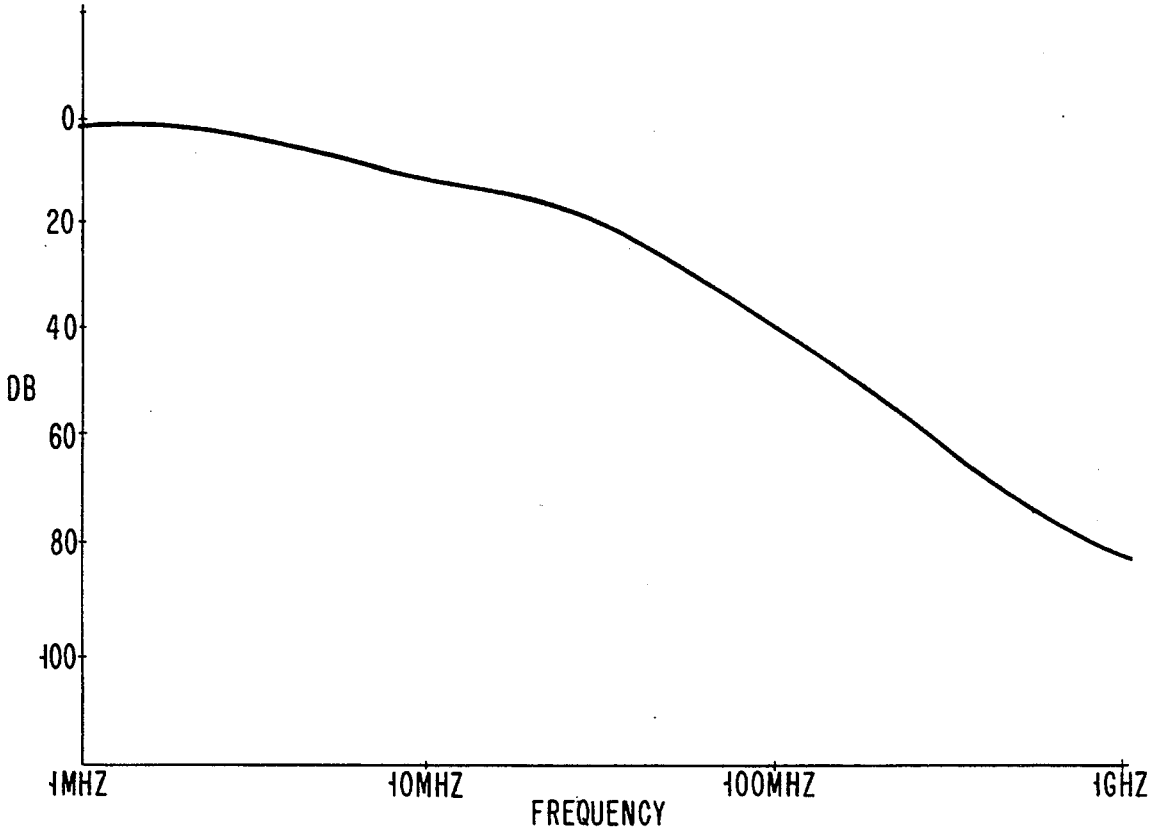
FIG. 4 illustrates a graph of an examplary "pi" filtering capability of the apparatus of FIG. 1.

FIG. 4 is a graph depicting the insertion loss for a specific embodiment similar to the apparatus of FIG. 1–3. A plurality of ferrite inductor beads served as a series connector for a pair of parallel planar capacitor arrays thereby forming a "pi" filter. A capacitance of 1500 pico-farads was utilized for each capacitor array and an induction of 2–3 micro-Henries was used. The total height of the connector assembly was less than one-quarter of an inch, the width approximately one-half inch and an overall length of approximately 2 inches. A plurality of gold plated copper leads were utilized, one lead disposed within each ferrite inductor bead and of sufficient length to provide suitable contact between complimentary elastomeric sheets. Each resilient sheet was replaced by a ceramic plate having matrix metal-on-elastomer elements serving as plugs of approximate size as each lead and serving to couple each lead to appropriate contact pads on the underlying or overlying PCB.

Those skilled in the art will readily recognize that various modifications and changes may be made to the present invention without departing from the true spirit and scope thereof, which is set forth in the following claims.

I claim:

1. A shielded stackable solderless connector apparatus for use in electronic devices comprising:

housing means of generally elongated shape and of semi-rigid material;

filter means disposed within the housing means; and identical paired resilient coupling means transferring signals through filtered connector pins between upper and lower circuits.

2. The apparatus of claim 1 wherein the filter means comprises a "pi" filter.

3. The apparatus of claim 1 wherein the filter means comprises capacitor filter means.

4. The apparatus of claim 1 wherein the filter means comprises resistive filter means.

5. The apparatus of claim 1 wherein the housing means is comprised of an electro-tin plated element.

6. The apparatus of claim 2 wherein the "pi" filter is comprised of paired planar capacitor arrays coupled by a plurality of ferrite inductor beads.

7. The apparatus of claim 1 further comprising a ground clip affixed to the housing means.

8. A shielded stackable solderless connector apparatus for use in electronic devices comprising:

housing means of generally elongated rectangular shape, of semi-rigid material having outwardly extending flanges that contain alignment means;

filter means disposed within the housing means; and identical paired resilient coupling means transferring signals through filtered connector pins between upper and lower circuits.

9. The apparatus of claim 8 wherein the filter means comprises a "pi" filter.

10. The apparatus of claim 8 wherein the filter means comprises capacitor filter means.

11. The apparatus of claim 8 wherein the filter means comprises resistive filter means.

12. The apparatus of claim 8 wherein the housing means is comprised of an electro-tin plated element.

13. The apparatus of claim 9 wherein the "pi" filter is comprised of paired planar capacitor arrays coupled by a plurality of ferrite inductor beads.

14. The apparatus of claim 8 further comprising a grounding clip affixed to the housing means.

* * * * *